US008628436B2

(12) United States Patent
Powell

(10) Patent No.: US 8,628,436 B2
(45) Date of Patent: Jan. 14, 2014

(54) LACROSSE STICK ACCESSORY

(76) Inventor: Ryan Powell, Portland, OR (US)

( * ) Notice: Subject to any disclaimer, the term of this patent is extended or adjusted under 35 U.S.C. 154(b) by 238 days.

(21) Appl. No.: 13/006,480

(22) Filed: Jan. 14, 2011

(65) Prior Publication Data

US 2011/0303056 A1 Dec. 15, 2011

Related U.S. Application Data

(60) Provisional application No. 61/353,368, filed on Jun. 10, 2010.

(51) Int. Cl.
*A63B 59/02* (2006.01)
*A63B 65/12* (2006.01)
*B25G 1/08* (2006.01)

(52) U.S. Cl.
USPC ..... 473/513; D21/724; 81/490

(58) Field of Classification Search
USPC ..... 473/505, 512, 513; D21/724, 756, 753; 81/490, 436, 62, 177.4; D8/82, 386; 279/96; 74/551.9; 215/248, 299
See application file for complete search history.

(56) References Cited

U.S. PATENT DOCUMENTS

| | | | | | |
|---|---|---|---|---|---|
| 341,986 | A * | 5/1886 | Alapaw | 81/62 |
| 688,517 | A * | 12/1901 | Held | 74/551.9 |
| 858,131 | A * | 6/1907 | Aichele | 81/490 |
| 1,109,507 | A * | 9/1914 | Bostock | 81/23 |
| 1,983,756 | A * | 12/1934 | Hessmert | 74/551.9 |
| 2,618,986 | A * | 11/1952 | Hungerford | 74/551.9 |
| 3,307,552 | A * | 3/1967 | Strawn | 604/256 |
| 3,964,339 | A * | 6/1976 | Antonio et al. | 74/551.9 |
| 4,206,918 | A * | 6/1980 | Lewis, Jr. | 473/513 |
| 4,268,927 | A * | 5/1981 | Bridwell | 7/143 |
| 4,270,756 | A * | 6/1981 | Ahlenfeld et al. | 473/513 |
| 4,631,770 | A * | 12/1986 | Goldberg | 7/167 |
| 5,540,623 | A * | 7/1996 | Symonds | 473/54 |
| 5,642,882 | A * | 7/1997 | Guerzini | 473/549 |
| 5,685,791 | A * | 11/1997 | Feeney | 473/513 |
| 5,881,615 | A * | 3/1999 | Dahl et al. | 81/490 |
| 6,050,158 | A * | 4/2000 | Cassutti et al. | 81/490 |
| 6,279,434 | B1 * | 8/2001 | Brown | 81/437 |
| 7,013,516 | B1 * | 3/2006 | Peters | 7/146 |
| 7,066,061 | B1 * | 6/2006 | Chen et al. | 81/439 |
| 7,108,616 | B2 * | 9/2006 | Morrow et al. | 473/513 |
| 2004/0248676 | A1 * | 12/2004 | Taylor et al. | 473/513 |
| 2008/0163434 | A1 * | 7/2008 | Jones et al. | 7/138 |
| 2009/0253539 | A1 * | 10/2009 | LoVine | 473/513 |
| 2011/0303056 | A1 * | 12/2011 | Powell | 81/490 |

* cited by examiner

*Primary Examiner* — Gene Kim
*Assistant Examiner* — M Chambers
(74) *Attorney, Agent, or Firm* — George R. McGuire; Bond Schoeneck & King, PLLC

(57) ABSTRACT

A lacrosse stick screwdriver assembly contained within a removable lacrosse stick butt end. The assembly comprises a drive head and a cavity to removably hold a screw all of which is adapted for containment within the butt end of the stick. When the lacrosse head is removed from the lacrosse stick, the screw holding them together is unscrewed and can be stored within the cavity of the assembly. The screw and screwdriver are thus stored with the lacrosse stick and are always available whenever needed, even on the playing field.

8 Claims, 6 Drawing Sheets

LACROSSE STICK ACCESSORY

CROSS-REFERENCE TO RELATED APPLICATION

The present application claims priority to U.S. Provisional Application Ser. No. 61/353,368 dated Jun. 10, 2010, the entirety of which is hereby incorporated by reference.

BACKGROUND OF THE INVENTION

1. Field of the Invention

The present invention relates to a lacrosse stick accessory, and, more specifically, to a lacrosse stick screwdriver assembly.

2. Description of the Related Art

Lacrosse is believed to be the oldest team contact sport in the United States. The sport involves a small rubber ball and a long-handled stick called a lacrosse stick. The lacrosse stick typically consists of a wood, metal (e.g., titanium), graphite, or plastic handle with a shaped head comprised of loose netting to catch and hold the lacrosse ball. Offensive players use the lacrosse stick to catch, carry, or throw the lacrosse ball in order to score on the opponent's goal. Defensive players attempt to prevent their opponent from scoring.

The popularity of lacrosse has increased considerably in just the last 10 years. There is currently estimated to be more than half a million lacrosse players in the United States alone, a number that is growing rapidly. According to U.S. Lacrosse®, between 2001 and 2006 the number of lacrosse players in the United States increased by a total of 68%.

When traveling with a lacrosse stick or storing a lacrosse stick, it is often necessary to remove the head from the shaft. The lacrosse head is typically screwed into the shaft with a single screw. A screwdriver is needed to unscrew the screw, allowing the head to be removed from the lacrosse stick. However, once the shaft and head are separated, the screw can become lost or misplaced. Additionally, when it is time to affix the head back onto the shaft it can be difficult to find a suitable screwdriver (and extra screw). Accordingly, there is a continued need for a lacrosse accessory that allows for installation and removal of the screw connecting the lacrosse head to the lacrosse stick without requiring a separate, and often hard to find, screwdriver, as well as access to a replacement screw.

BRIEF SUMMARY OF THE INVENTION

It is therefore a principal object and advantage of the present invention to provide a screwdriver assembly for a lacrosse stick.

It is another object and advantage of the present invention to provide a screwdriver assembly that prevents the loss or misplacement of a screw that has temporarily been unscrewed from the head and shaft.

It is yet another object and advantage of the present invention to provide a screwdriver that is at all times associated with the lacrosse stick.

Other objects and advantages of the present invention will in part be obvious, and in part appear hereinafter.

In accordance with the foregoing objects and advantages, the present invention provides a lacrosse stick screwdriver assembly. The assembly comprises a butt end (e.g., the small plastic/rubber cap covering the end of the lacrosse stick), wherein when the butt end is removed from the lacrosse stick the butt end defines a first opening and a first cavity. The assembly further comprises a screwdriver removably retained within the cavity, wherein the screwdriver comprises a base, a pedestal, and a drive head, the base further comprising a second opening and the pedestal defining a second cavity. The screwdriver further comprises a bottom cover removably covering the second opening and enclosing the second cavity, wherein in a first configuration the second cavity comprises a screw removed from the lacrosse stick.

BRIEF DESCRIPTION OF THE SEVERAL VIEWS OF THE DRAWING(S)

The present invention will be more fully understood and appreciated by reading the following Detailed Description in conjunction with the accompanying drawings, in which.

DETAILED DESCRIPTION OF THE INVENTION

Figure 1:
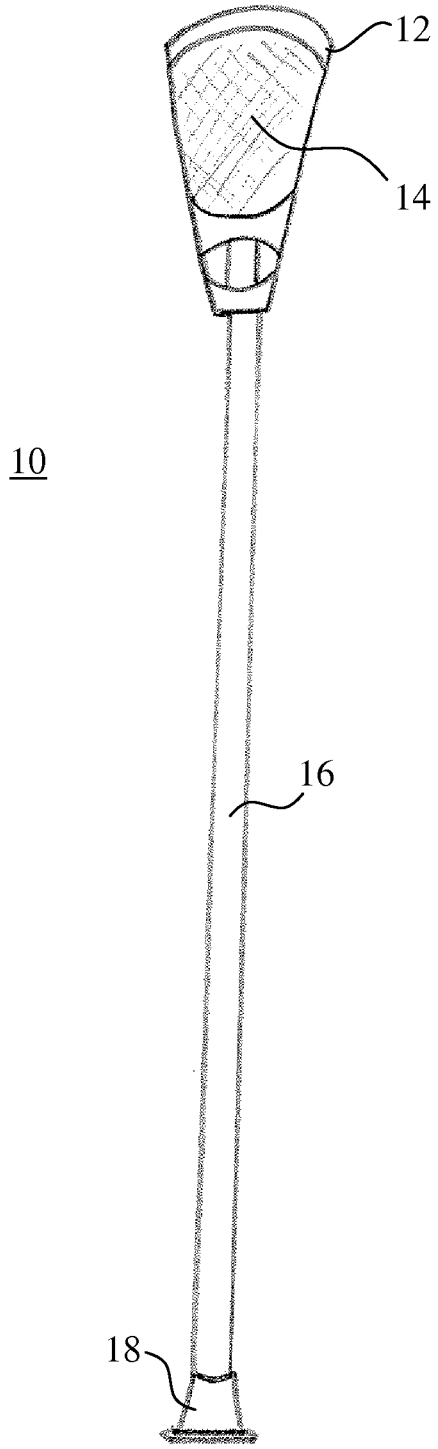
FIG. 1 is a front view of a lacrosse stick according to one embodiment of the present invention.

Referring now to the drawings, wherein like reference numerals refer to like parts throughout, there is seen in FIG. 1 a lacrosse stick 10 according to one embodiment of the present invention. Lacrosse stick 10 generally comprises a head 12 with netting 14, shaft 16, and butt end 18. One skilled in the art will recognize that lacrosse sticks can be comprised of many different types and combinations of materials, and can be a wide variety of sizes and shapes depending upon the personal preferences or needs of the user and the regulations of the league in which lacrosse stick 10 will be used.

Figure 2:
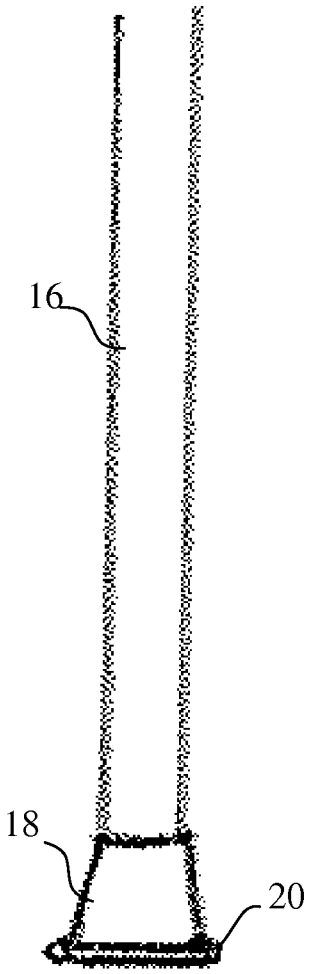
FIG. 2 is a side elevation view of the lower portion of a lacrosse shaft with a butt end according to one embodiment of the present invention.

FIG. 2 provides a view of the lower portion of lacrosse stick 10. Shaft 16 ends in butt end 18, which is connected to the shaft through any means known in the art. In a preferred embodiment, butt end 18 is comprised of rubber/plastic and fits snugly onto the end of shaft 16 where it is retained through frictional means. Butt end 18 optionally includes a lower rim/flange 20 that extends slightly outwardly in a radial direction from the lowest region/terminal end of the butt end.

Figure 3:
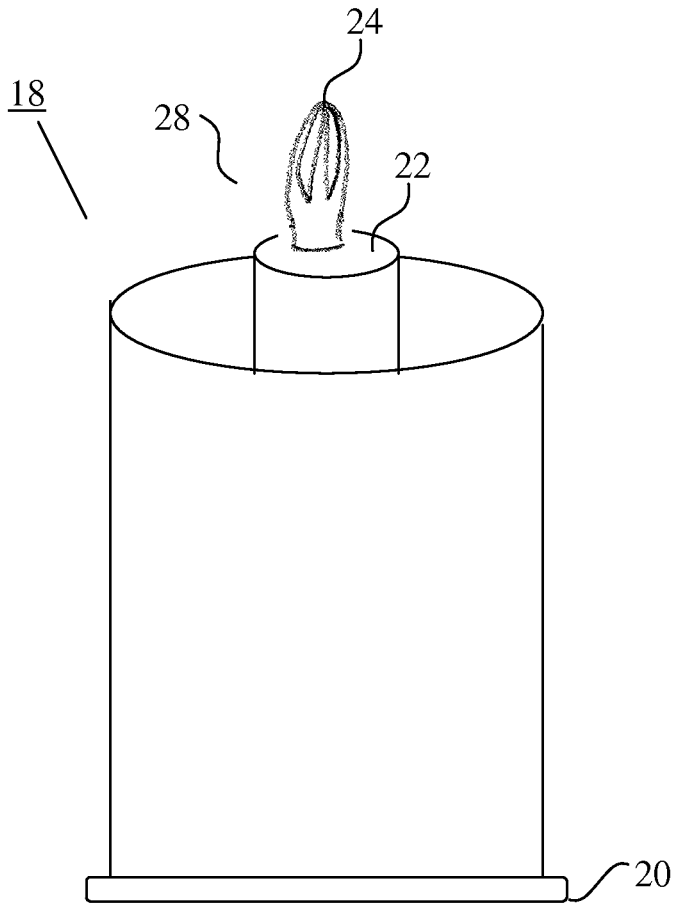
FIG. 3 is a side elevation view of the butt end screwdriver assembly removed from the bottom of the lacrosse shaft.
Figure 4:
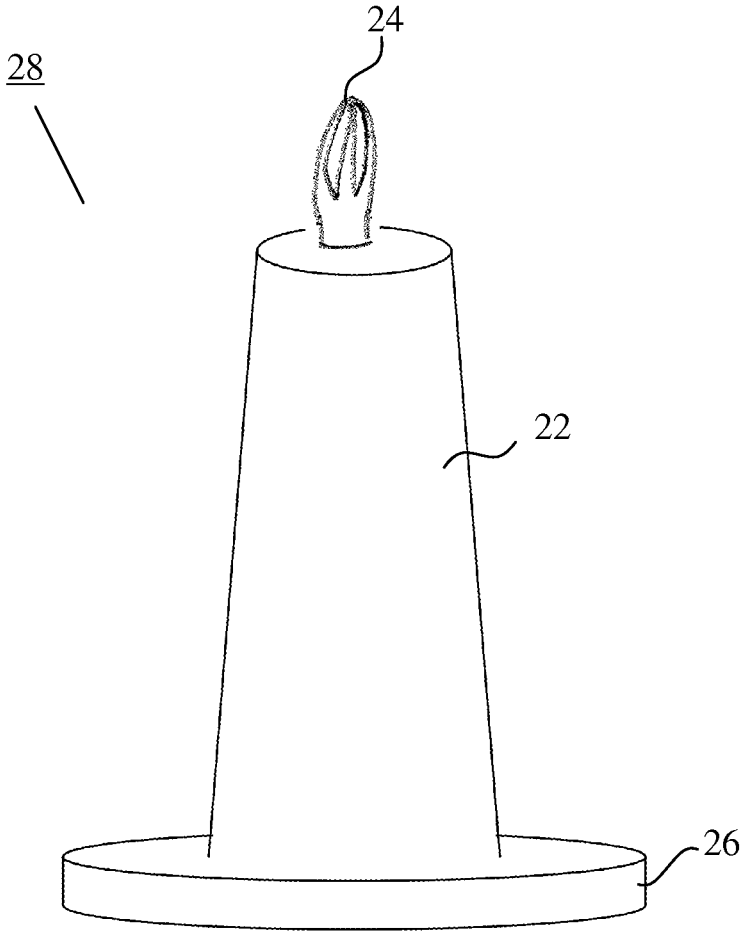
FIG. 4 is a side view of the screwdriver assembly removed from the butt end.

Butt end 18 can be removed from shaft 16 (as it shown separately in FIG. 3.) When removed from the shaft 16, butt end 18 reveals the screwdriver assembly 28. The assembly 28 comprises at least a pedestal 22, a driver head 24, and a base 26, as shown in FIG. 4. In one configuration, assembly 28 fits snugly into butt end 18 to prevent movement of the screwdriver assembly when the lacrosse stick is being used. This can be especially beneficial if the shaft of the lacrosse stick is hollow. In a preferred embodiment, assembly 28 fits snugly into the bottom of butt end 18 where it is retained through frictional means. In this embodiment, base 26 of the assembly is trapped between the inner bottom surface of butt end 18 and the bottom surface of the lacrosse shaft 16, further retaining the assembly in the butt end. One skilled in the art, however, will recognize that assembly 28 can be retained through any mechanism that retains it in the butt end, and could also be formed as an integral unit.

Figure 5:
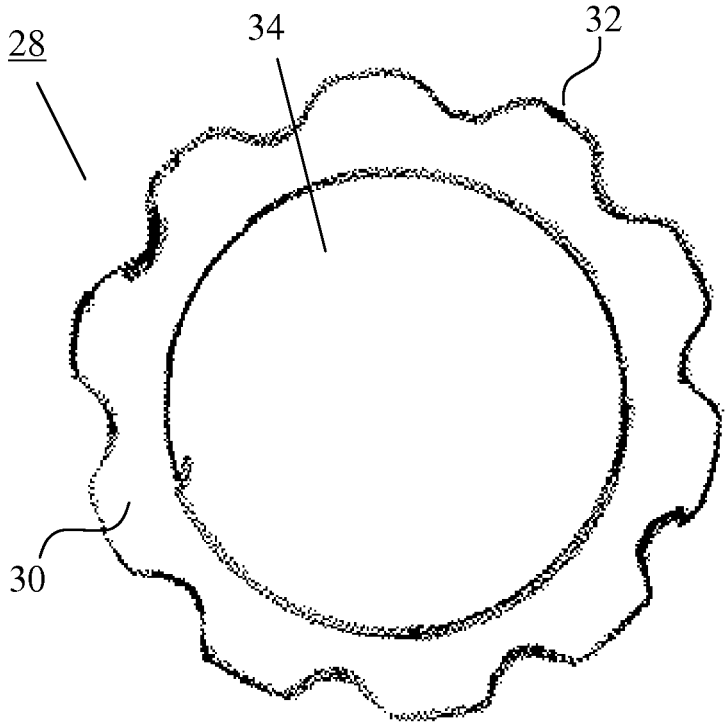
FIG. 5 is a bottom view of the screwdriver assembly removed from the butt end.
Figure 6A:
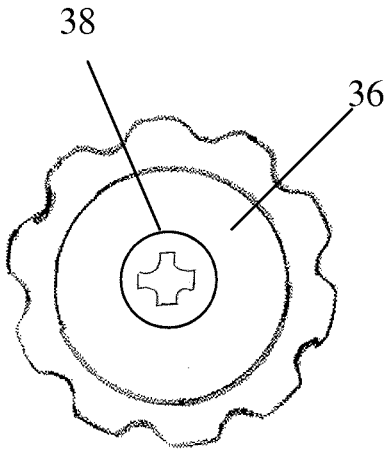
FIGS. 6A-6C are bottom views with the base of the screwdriver assembly removed to expose a screw contained within, with a Philips or crosshead drive, a slotted or flat drive, and a hex, square, or Allen drive, respectively.
Figure 6B:
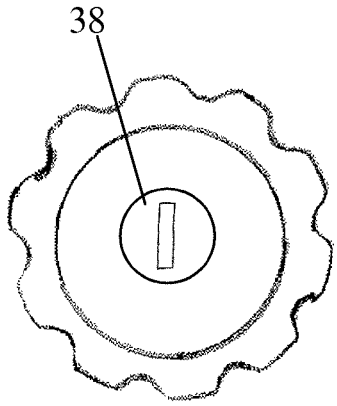
Figure 6C:
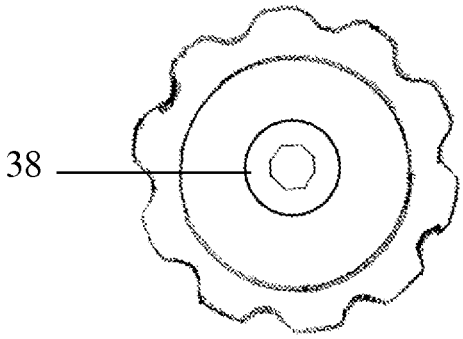

FIG. 5 is a bottom view of screwdriver assembly 28. The assembly includes a bottom surface 30 of base 26 with a series of ridges 32. These optional ridges serve to further grip and retain assembly 28 within butt end 18. The bottom surface 30 further comprises a bottom plate 34 which is removable. When removed, bottom plate 34 reveals a cavity 36, shown in FIGS. 6A-6C. When head 12 is removed from shaft 16, screw 38 can be stored within cavity 36. The drive of screw 38 can be any type of drive known in the art, including a Philips or crosshead drive as shown in FIG. 6A, a slotted or flat drive as shown in FIG. 6B, and a hex or Allen drive as shown in FIG. 6C, among many others (e.g., square socket). Correspondingly, driver head 24 of assembly 28 can be any type of driver head known in the art, depending on the type of screw used to connect the lacrosse head and shaft, and could also be of different lengths and sizes to accommodate different types of screws.

Screwdriver assembly 28 is used to remove head 12 from shaft 16. To remove the head, butt end 18 is first removed from the bottom of shaft 16, and the assembly is optionally removed from the butt end. Using driver head 24, screw 38 is unscrewed from the head and stick. This removes the head from the shaft. Once freed from the head and shaft, screw 38 is placed inside cavity 36 of the assembly, the bottom plate 34 is placed back on assembly to retain the screw inside the cavity, and the assembly is snugly placed back into butt end 18. The butt end is then snugly forced back onto shaft 16. The screw and screwdriver assembly are now safely retained with the shaft and can be retrieved whenever necessary.

To reconnect the head to shaft 16, butt end 18 is first removed from the bottom of shaft 16, and the assembly is removed from the butt end. The bottom plate 34 is removed from the assembly thereby revealing cavity 36 and screw 38. The screw is removed from the cavity and, using driver head 24, the screw is screwed back into the head and stick, thereby reconnecting the head and the shaft. The bottom plate 34 is snapped back onto assembly 28, and the assembly is snugly placed back into butt end 18. The butt end is then snugly forced back onto shaft 16. The screwdriver assembly is now safely retained with the shaft and can be retrieved whenever necessary.

Although the present invention has been described in connection with a preferred embodiment, it should be understood that modifications, alterations, and additions can be made to the invention without departing from the scope of the invention as defined by the claims.

What is claimed is:

1. An accessory for use in combination with a lacrosse stick having an elongated shaft that terminates at a first end and includes a lacrosse head mounted at its opposite, second end, the accessory comprising:

a. a butt cover adapted for positioning over the first end of the shaft and comprising a closed end and at least one sidewall that extends upwardly from said closed end, wherein said closed end and said at least one sidewall define a cavity, wherein said butt cover is mounted to said shaft by frictional engagement of at least a portion of said at least one sidewall with said first end of the shaft;

b. a base adapted for removeable positioning within said cavity;

c. a pedestal extending outwardly from said base; and d. a tool attached to said pedestal and adapted for storage in said cavity when not in use and for selective removal from said cavity, wherein said tool is adapted for use in maintenance of the lacrosse stick wherein said tool is a screwdriver.

2. The accessory of claim 1, wherein the periphery of said base has a predetermined shape.

3. The accessory of claim 2, wherein said predetermined shape is defined by a series of ridges.

4. The accessory of claim 2, wherein said at least one sidewall defines a predetermined cross-sectional internal shape and further wherein said predetermined shape of said periphery of said base is complementary to said cross-sectional internal shape.

5. The accessory of claim 1, wherein said base and said pedestal are integrally formed with said butt cover.

6. The accessory of claim 1, wherein said screwdriver is a Phillips head screwdriver.

7. The accessory of claim 1, wherein said screwdriver is a flat head screwdriver.

8. The accessory of claim 1, wherein said screwdriver is an Allen head screwdriver.

* * * * *